US006275594B1

(12) United States Patent
Senoo et al.

(10) Patent No.: US 6,275,594 B1
(45) Date of Patent: Aug. 14, 2001

(54) PIEZOELECTRIC ACOUSTIC DEVICE

(75) Inventors: Masao Senoo, Saitama-ken; Tsuyoshi Yamashita; Tadao Sunahara, both of Toyama Pref., all of (JP)

(73) Assignee: Hokuriku Electric Industry Co., Ltd., Toyama Pref. (JP)

( * ) Notice: Subject to any disclaimer, the term of this patent is extended or adjusted under 35 U.S.C. 154(b) by 0 days.

(21) Appl. No.: 09/260,817

(22) Filed: Mar. 2, 1999

(30) Foreign Application Priority Data

Mar. 2, 1998 (JP) ..... 10-049183

(51) Int. Cl.[7] ..... H04R 3/00
(52) U.S. Cl. ..... 381/114; 381/190; 381/173
(58) Field of Search ..... 381/114, 111, 381/173, 190, 191; 310/324

(56) References Cited

U.S. PATENT DOCUMENTS

| | | | | |
|---|---|---|---|---|
| 3,970,879 | | 7/1976 | Kumon . | |
| 4,122,365 | | 10/1978 | Stephens . | |
| 4,156,800 | * | 5/1979 | Sear | 381/114 |
| 4,183,017 | | 1/1980 | Sims . | |
| 5,321,761 | * | 6/1994 | Kitanishi | 381/114 |

FOREIGN PATENT DOCUMENTS

| | | |
|---|---|---|
| 59-879 | 1/1984 | (JP) . |
| 6-75578 | 3/1994 | (JP) . |
| 7-281670 | 10/1995 | (JP) . |

* cited by examiner

*Primary Examiner*—Minsun Oh Harvey
(74) *Attorney, Agent, or Firm*—Rankin, Hill, Porter & Clark LLP

(57) ABSTRACT

A piezoelectric acoustic device capable of permitting an increase in area or space of an operation face section of an electronic equipment required for arranging parts for the electronic equipment, attaining small-sizing of an electronic equipment and minimizing intrusion of water and dust into a front air chamber through a drum. The piezoelectric acoustic device includes a piezoelectric vibrator including a metal vibrating plate and a piezoelectric ceramic element joined to the metal vibrating plate, a casing including a front side wall and a rear side wall arranged on both sides of the piezoelectric vibrator so as to define a space therebetween in which the piezoelectric vibrator is received, and a drum arranged on an outside of the front side wall so as to extend in a direction across the front side wall. The piezoelectric vibrator and front side wall are arranged so as to define a chamber therebetween and the drum is formed therein with a passage in a manner to communicate with the chamber. The drum is so arranged that a center thereof is deviated from a center of the front side wall toward an outer peripheral portion of the front side wall.

10 Claims, 3 Drawing Sheets

PIEZOELECTRIC ACOUSTIC DEVICE

BACKGROUND OF THE INVENTION

This invention relates to a piezoelectric acoustic device, and more particularly to a piezoelectric acoustic device in the form of a piezoelectric speaker, a piezoelectric buzzer or the like which is used for an electronic equipment such as a portable telephone or the like.

In general, a piezoelectric acoustic device includes a casing made of an insulating resin material or the like and a piezoelectric vibrator received in the casing. In recent years, it is highly demanded to small-size an electronic equipment and provide it with multiple functions. For this purpose, it is required that the electronic equipment is provided on a surface thereof or an operation face section thereof with parts for multi-functioning. The parts include, for example, a liquid-crystal display element for a telephone receiver, various kinds of switches and the like. Arrangement of such additional parts on the operation face section of the electronic equipment or large-sizing of the parts requires to increase an area of the operation face section. However, an increase in area of the operation face section is contrary to small-sizing of the electronic equipment.

A piezoelectric acoustic device which has been conventionally used for such an electronic equipment is disclosed in, for example, Japanese Utility Model Publication No. 879/1984, Japanese Patent Application Laid-Open Publication No. 75578/1994, Japanese Patent Application Laid-Open Publication No. 28167/1995, U.S. Pat. No. 3,970,879, U.S. Pat. No. 4,122,365, U.S. Pat. No. 4,183,017 and the like. The piezoelectric acoustic device disclosed is generally constructed in the form of a piezoelectric buzzer or a piezoelectric speaker which includes a casing and a drum provided at a substantially central portion of a front side wall of the casing in a manner to communicate with the casing. Unfortunately, the conventional piezoelectric acoustic device fails to increase an area of an operation face section of an electronic equipment because the drum is arranged at the substantially central portion of the front side wall of the casing.

SUMMARY OF THE INVENTION

Accordingly, it is an object of the present invention to provide a piezoelectric acoustic device which is capable of permitting an increase in area or space of an operation face section of an electronic equipment required for arranging parts for the electronic equipment.

It is another object of the present invention to provide a piezoelectric acoustic device which is capable of attaining small-sizing of an electronic equipment.

It is a further object of the present invention to provide a piezoelectric acoustic device which is capable of minimizing intrusion of water and dust into a front air chamber through a drum.

It is still another object of the present invention to provide a piezoelectric acoustic device which is capable of eliminating arrangement of any waterproof or dust-proof cloth member at a sound discharge hole of a housing of an electronic equipment.

In accordance with the present invention, a piezoelectric acoustic device is provided. The piezoelectric acoustic device includes a piezoelectric vibrator including a metal vibrating plate and a piezoelectric ceramic element joined to the metal vibrating plate, a casing including a front side wall and a rear side wall arranged on both sides of the piezoelectric vibrator so as to define a space therebetween in which the piezoelectric vibrator is received, and a drum arranged on an outside of the front side wall so as to extend in a direction across the front side wall. The piezoelectric vibrator and front side wall are arranged so as to define a chamber therebetween and the drum is formed therein with a passage in a manner to communicate with the chamber. The drum is so arranged that a center thereof is deviated from a center of the front side wall toward an outer peripheral portion of the front side wall. Such construction, when the piezoelectric acoustic device of the present invention is mounted in a housing of an electronic equipment, permits a gap of a size substantially equal to a length of the drum or less to be formed between the housing and the piezoelectric acoustic device, so that parts such as a circuit board and the like may be arranged in the gap. This results in the electronic equipment being small-sized. In particular, the drum is arranged at a position deviated from the center of the front side wall of the casing toward the outer peripheral portion of the front side wall, so that an operation face section of the housing of the electronic equipment may be significantly increased in space or area in which electronic parts such as a display element, switches and the like are arranged.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a piezoelectric acoustic device according to the present invention will be described hereinafter with reference to the accompanying drawings.

Figure 1:
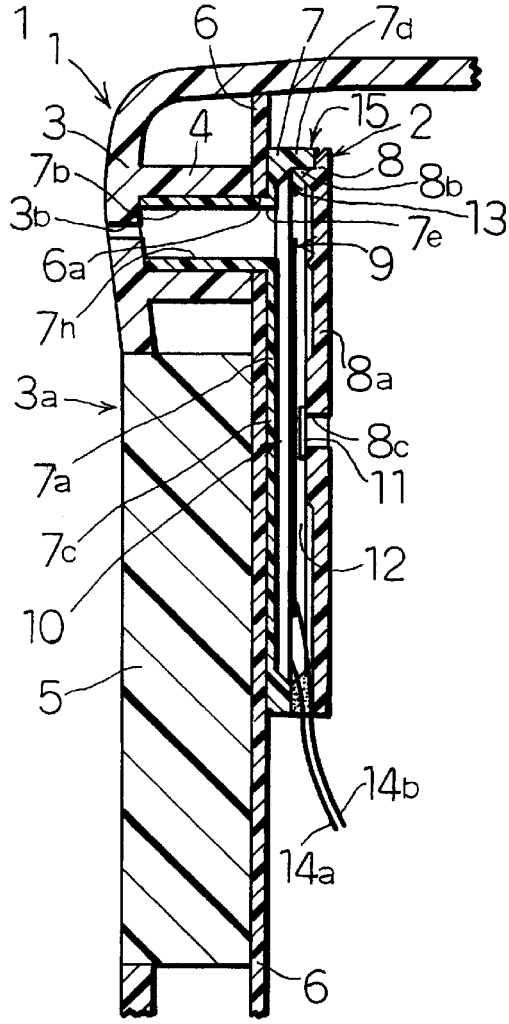
FIG. 1 is a fragmentary schematic sectional view showing a receiver of a portable telephone in which an embodiment of a piezoelectric acoustic device according to the present invention is incorporated.
Figure 2:
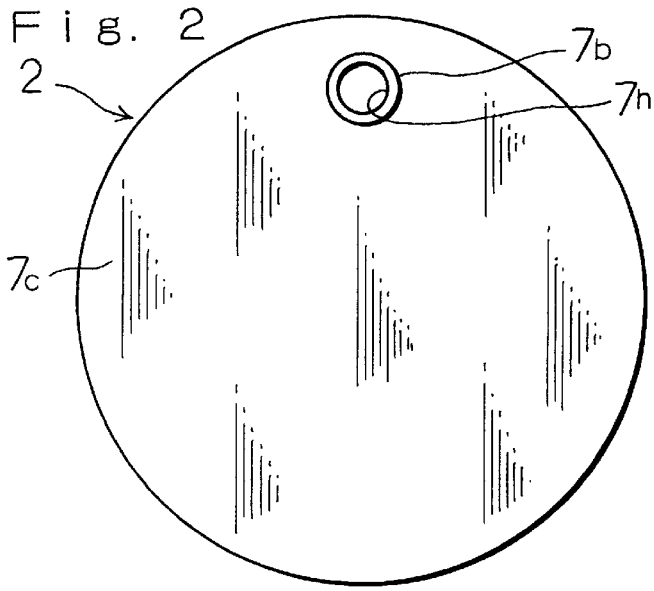
FIG. 2 is a schematic plan view of the piezoelectric acoustic device shown in FIG. 1.

Referring first to FIGS. 1 and 2, an embodiment of a piezoelectric acoustic device according to the present invention is illustrated, wherein FIG. 1 shows a receiver of a portable telephone in which a piezoelectric acoustic device of the illustrated embodiment is incorporated and FIG. 2 shows the piezoelectric acoustic of the illustrated embodiment.

The telephone receiver, as shown in FIG. 1, includes a housing 1, in which the piezoelectric acoustic device of the illustrated embodiment generally designated at reference numeral 2 is incorporated. The housing 1 includes a housing body 3, which is integrally provided on an inner surface thereof with a cylindrical fit section 4 in which a drum 7*b* of the piezoelectric acoustic device 2 which is formed into a cylindrical shape is fitted. The housing body 3 includes an operation face section 3*a* provided thereon with a liquid crystal display element 5 and the like. The housing body 3 is formed with a sound discharge hole 3*b* in the form of a through-hole in a manner to positionally correspond to the cylindrical fit section 4. The cylindrical fit section 4 is mounted on an end surface thereof with a printed board 6 in a manner to be in parallel to the operation face section 4 and contacted with the end surface. The printed board 6 is formed with a fit hole 6*a* in the form of a through-hole, through which the drum 7*b* of the piezoelectric acoustic device 2 is inserted. The cylindrical fit section 4 is fitted therein with the drum 7*b* of the piezoelectric acoustic device 2 while interposing the printed board 6 between a disc-like front side wall 7*c* of the piezoelectric acoustic device 2 and the cylindrical fit section 4. The display element 5 and piezoelectric acoustic device 2 are mounted on the printed board 6 by means of an adhesive or a double-coated tape.

The piezoelectric acoustic device 2 includes the drum 7*b* and a two-part receiving casing or insulating casing 15 constructed of a front casing member 7 constituting a first casing half and a rear casing member 8 constituting a second casing half and fitted in the front casing member 7. The insulating casing 15 has a piezoelectric vibrator 9 received therein, which is constructed so as to vibrate depending on an electrical signal. In the illustrated embodiment, both casing members 7 and 8 are sealedly joined at a fit section therebetween to each other by welding or the like, to thereby prevent leakage of air from the fit section. The front casing member 7 is constituted of the disc-like front side wall 7*c* and a substantially annular peripheral wall 7*d* arranged on an outer peripheral portion of the front side wall 7*c* so as to surround the outer peripheral portion and upwardly extend therefrom. The front casing member 7 is integrally formed of a PPO resin material containing glass. The front side wall 7*c* is formed with a front side opening 7*e* or an opening of a circular shape facing a front air chamber described hereinafter. The front side opening 7*e* is arranged rather in proximity to the outer peripheral portion of the front side wall 7*c*. More specifically, the front side opening 7*e* has a center defined at a position deviated from a center of the front side wall 7*c* toward the outer peripheral portion of the front side wall 7*c*.

The drum 7*b* is arranged on an outside of the front side wall 7*c* so as to extend in a direction across the front side wall 7*c*. In the illustrated embodiment, it is arranged so as to extend in a direction substantially perpendicular to the front side wall 7*c*. The drum 7*b* is formed into a cylindrical shape and provided therein with a passage 7*h*, which is arranged so as to communicate through the front side opening 7*e* with a space or first chamber 10 defined between the front side wall 7*c* and the piezoelectric vibrator 9. Such construction of the drum 7*b* permits the drum 7*b* to have a center deviated from the center of the front side wall 7*c* toward the outer peripheral portion of the front side wall 7*c*. As will be noted from FIG. 1, the drum 7*b* is formed into a diameter smaller than a radius of the front side wall 7*c*. The drum 7*b* is abutted at a distal end or outer end thereof against an inner surface of the housing body 3 so that the passage 7*h* of the drum 7*b* may communicate through the sound discharge hole 3*b* of the housing body 3 with an exterior of the housing body 3. In the illustrated embodiment, the first chamber 10 and passage 7*h* cooperate with each other to provide the front air chamber briefly described above. The front air chamber 7*h*, 10 and sound discharge hole 3*b* each are formed into a configuration and dimensions which permit resonance to be generated therein.

The rear casing member 8 constituting the second casing half includes a disc-like rear side wall 8*a* and a cylindrical peripheral wall 8*b* arranged on the rear side wall 8*a* so as to be raised therefrom while leaving an edge of the rear side wall 8*a*. The rear casing member 8 is integrally formed of insulating resin or PPO resin like the front casing member 7. The rear side wall 8*a* is formed with a rear side opening 8*c* in a manner to pass therethrough. The rear side wall 8*a* is arranged at a center of the rear side wall 8*a* and has a damping cloth member 11 joined or adhered to an inner surface thereof so as to close or cover the rear side opening 8*c*.The damping cloth member 11 is formed of a woven fabric of polyester into a thickness of 8 mm and fixed onto the inner surface of the rear side wall 8*a* by means of an adhesive, a pressure-sensitive adhesive or a solvent. The damping cloth member 11 is formed with small vent holes. Thus, the damping cloth member 11 is preferably mounted on the rear side wall 8*a* by previously applying a pressure-sensitive adhesive to a predetermined portion of the inner surface of the rear side wall 8*a* and forcedly pressing the damping cloth member 11 onto the pressure-sensitive adhesive, resulting in keeping the small vent holes from being clogged with the adhesive. The rear side opening 8*c* cooperates with the piezoelectric vibrator 9 to define a space or second chamber 12 therebetween, which constitutes a rear air chamber.

The insulating casing 15 is formed by joining the peripheral wall 7*d* of the front casing member 7 and the peripheral wall 8*b* of the rear casing member 8 to each other by fitting. The insulating casing 15 is provided therein with a groove 13 of a substantially V-shape in cross section by fitting between the peripheral wall 7*d* and the peripheral wall 8*b*. The groove 13 is so formed that a cross section thereof gradually linearly enlarges toward a center of the insulating casing 15, resulting in receiving a peripheral edge of the piezoelectric vibrator 9 therein.

Figure 3:
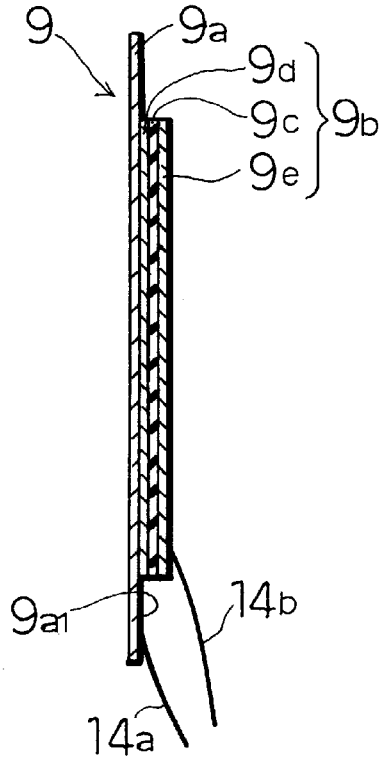
FIG. 3 is a schematic sectional view showing a piezoelectric vibrator incorporated in the piezoelectric acoustic device shown in FIG. 1.

The piezoelectric vibrator 9, as shown in FIG. 3, includes a vibrating plate 9*a* made of metal and a piezoelectric ceramic element 9*b* arranged on one surface of the metal vibrating plate 9*a* in a manner to leave an outer peripheral portion 9*a*1 of the vibrating plate 9*a*. The piezoelectric vibrator 9 is arranged in the insulating casing 15 in such a manner that the piezoelectric ceramic element 9*b* is rendered opposite to the rear side wall 8*a* of the rear casing member 8. In FIG. 3, a thickness of each of the parts is emphasized for the sake of brevity. The piezoelectric vibrator 9 is securely fitted at the peripheral edge thereof in the V-shaped groove 13 of the insulating casing 15 by means of an adhesive or a pressure-sensitive adhesive. The metal vibrating plate 9*a* is made of a circular metal plate of FeNi alloy. The piezoelectric ceramic element 9*b* includes a piezoelectric ceramic member 9*c*, as well as a joint electrode layer 9*d* and a non-joint electrode layer 9*e* respectively arranged on both surfaces of the piezoelectric ceramic member 9*c*. The junction electrode layer 9*d* is joined to the metal vibrating plate 9*a* so as to be electrically connected thereto. The metal vibrating plate 9*a* has a lead wire 14*a* connected to the outer peripheral portion 9*a*1 thereof and the non-joint electrode layer 9*e* likewise has a lead wire 14*b* connected thereto. Such connection of the lead wires 14*a* and 14*b* may be carried out by soldering. The piezoelectric vibrator 9 vibrates depending on an electric signal fed through the lead wires 14*a* and 14*b* to the metal vibrating plate 9*a* and non-joint electrode layer 9*e*.

In the illustrated embodiment, the drum 7*b* of the front casing member 7 is arranged in a manner to be deviated toward the outer peripheral portion of the front side wall 7*c* of the front casing member and is formed into a diameter reduced as compared with a radius of the front side wall 7*c*. Such construction permits the sound discharge hole 3*b* of the housing 1 of the telephone receiver to be positioned in a manner to be deviated toward an end of the housing, when the piezoelectric acoustic device 2 is arranged in the housing 1 so that the drum 7*b* is positioned on a side of the end of the receiver as in the illustrated embodiment. Also, the illustrated embodiment permits the surface of the front side wall 7*c* of the front casing member 7 to be separated from the housing 1 by a distance substantially equal to a length of the drum 7*b* or less, so that the liquid crystal display element 5 and printed board 6 may be arranged in a gap between the housing 1 and the front side wall 7*c* of the front casing member 7. This permits the display element 5 increased in size as in the prior art to be arranged on a side of the operation face section of the housing 1.

Figure 4:
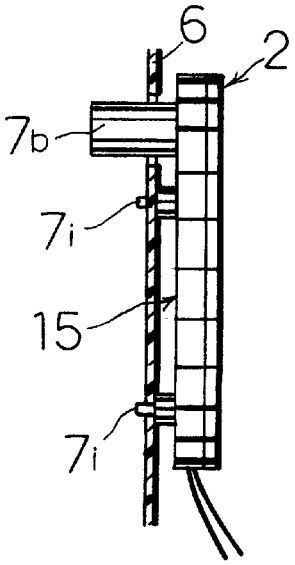
FIG. 4. is a fragmentary schematic sectional view showing a receiver of a portable telephone in which another embodiment of a piezoelectric acoustic device according to the present invention is incorporated.
Figure 5:
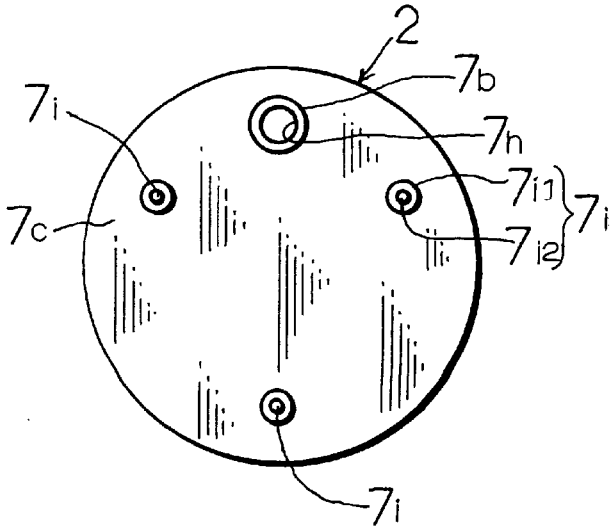
FIG. 5 is a schematic plan view of the piezoelectric acoustic device shown in FIG. 4.

In the illustrated embodiment, the piezoelectric acoustic device 2 and printed board 6 are closely joined to each other. However, when the number of parts of an electronic equipment mounted on printed board 6 is increased, the piezoelectric acoustic device of the present invention may be constructed as shown in FIGS. 4 and 5, which illustrate a second embodiment of a piezoelectric acoustic device according to the present invention. More particularly, in a piezoelectric acoustic device of the second embodiment generally designated at reference numeral 2, a front casing member 7 is formed on a front side wall 7*c* thereof with three spacer projections 7*i*, which are formed into a length smaller than that of a drum 7*b* and arranged so as to extend in the same direction as the drum 7*b*. The spacer projections 7*i* each are joined to a printed board 6 by heat fusion or screwing, so that the piezoelectric acoustic device 2 may be mounted on the printed board 6. In the illustrated embodiment, the spacer projections 7*i* each are formed by providing a fit projection 7*i*2 of a small diameter on a projection 7*i* of a large diameter. Then, the fit projections 7*i*2 each are inserted via each of through-holes formed through the printed board 6 and then thermally deformed or melted to prevent dislocation of the spacer projection 7*i*. This permits parts mounted on the printed board 6 to be arranged in a gap 15 defined by the projection 7*i* of each of the spacer projections 7*i* between the piezoelectric acoustic device 2 and the printed board 6. Also, mounting of a display element 5 on the printed board 6 may be carried out by forming the display element 5 with at least one spacer projection and then joining the spacer projection to the printed board 6 by heat fusion or screwing.

Figure 6:
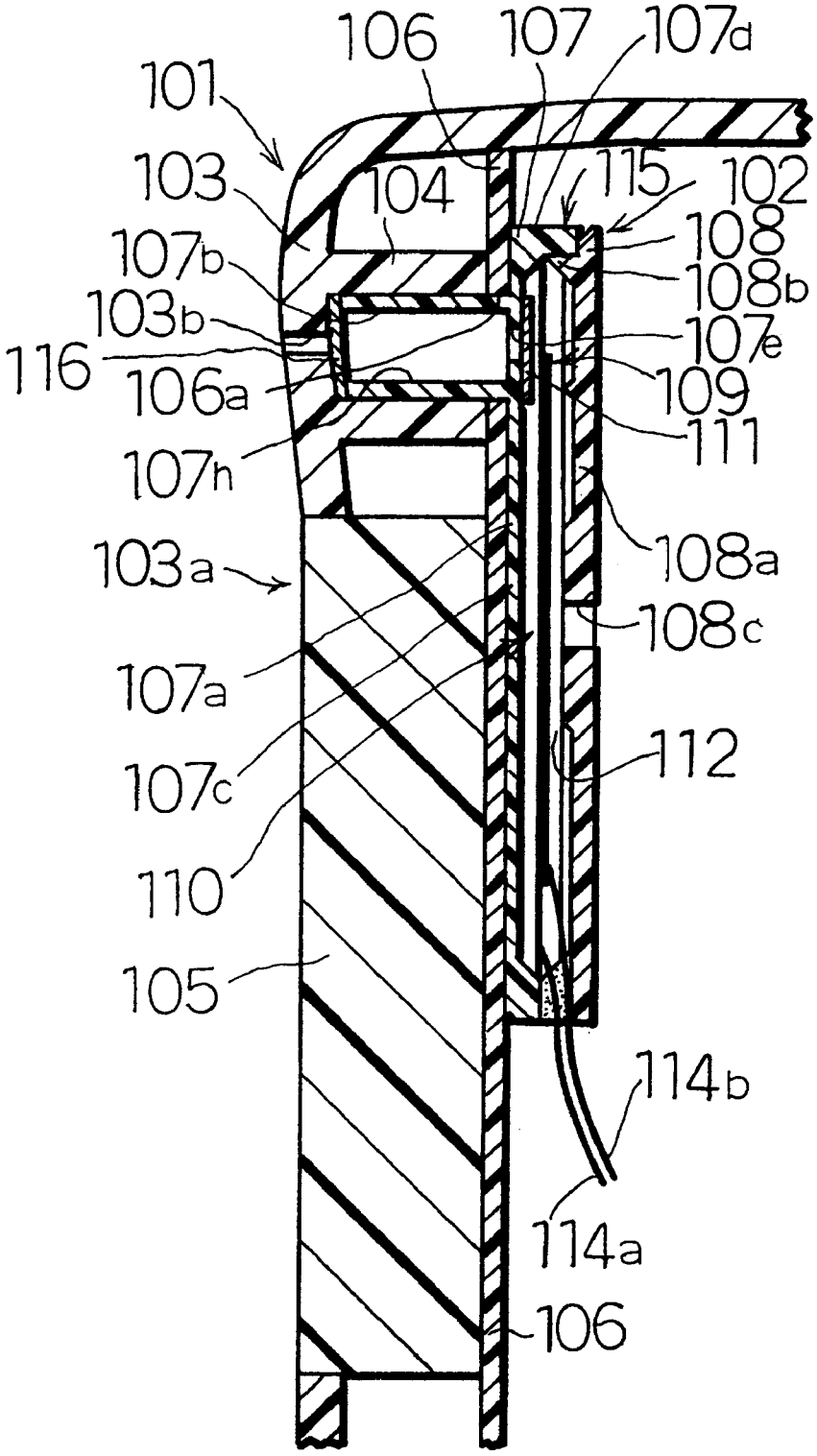
FIG. 6 is a fragmentary schematic sectional view showing a receiver of a portable telephone in which a further embodiment of a piezoelectric acoustic device according to the present invention is incorporated.

Referring now to FIG. 6, a further or third embodiment of a piezoelectric acoustic device according to the present invention is illustrated. A piezoelectric acoustic device of the illustrated embodiment is constructed in substantially the same manner as the embodiment described above with reference to FIG. 1, except a structure of a front casing member and a position at which a damping cloth member is arranged. Thus, in the illustrated embodiment, reference numerals correspond to the reference numerals discussed above with reference to FIG. 1, except with an additional prefix of 100, i.e. such that a front casing member 7 previously shown is now a front casing member 7 107.

The piezoelectric acoustic device of the illustrated embodiment generally designated at reference numeral 102 is so constructed that a front side opening 107*e* is formed into a diameter smaller than an inner diameter of a drum 107*b*. A rear side opening 108*c* is not covered with a damping cloth member. Instead, a front side wall 107*c* has a damping cloth member 111 joined to an inner surface thereof so as to close the front side opening 107*e*. The damping cloth member 111 is formed of a woven fabric of polyester into a thickness of 0.08 mm and fixed to the inner surface of the front side wall 107*c* by means of an adhesive, a pressure-sensitive adhesive or a solvent. In the illustrated embodiment, a first chamber 110 constitutes a front air chamber and a second chamber 112 constitutes a rear air chamber.

Also, the piezoelectric acoustic device 102 of the illustrated embodiment includes a waterproof or dust-proof cloth member 116 arranged between the end of the drum 107*b* and a wall of a housing body 103 so as to close or cover a sound discharge hole 103*b*. The cloth member 116 is formed of a woven fabric of 0.08 mm in thickness and fixed to an inner surface of the housing body 103 surrounded by the cylindrical fit section 104. The drum 107*b* is abutted against the cloth member 116 so as to permit a passage 107*h* to communicate through the sound discharge hole 103*b* with an exterior of the housing body 103. Thus, in the piezoelectric acoustic device 102 of the illustrated embodiment, the damping cloth member 111 is arranged so as to close the front side opening 107*e*, so that the cloth member 116 may effectively prevent water and dust passing through the cloth member 116 from entering the first chamber 110 constituting the front air chamber.

In the illustrated embodiment as well, when the number of parts of an electronic equipment is increased, the side wall 107*c* of the piezoelectric acoustic device 102 is provided thereon with at least one spacer projection in a manner to extend in the same direction as the drum 107*b* as in FIGS. 4 and 5. Then, the spacer projection thus formed is joined to a printed board 106 by heat fusion or screwing, resulting in the piezoelectric acoustic device 102 being mounted on the printed board 106.

In the illustrated embodiment, as described above, the damping cloth member 111 is arranged on a side of the front side opening 107*e* rather than on a side of the rear side opening 108*c*. Such arrangement of the damping cloth member 111 permits it to prevent water or dust passing through the waterproof or dustproof cloth member 116 arranged for closing the sound discharge hole 103 of a housing 101 from intruding into the first chamber 110. This effectively keeps an adhesive or pressure-sensitive adhesive for fixing a piezoelectric vibrator 109 onto an insulating casing 115 from being deteriorated.

Also, the illustrated embodiment may be so constructed that the damping cloth member 111 fully exhibits a function of the waterproof or dust-proof cloth member 116 as well as its own function. This eliminates arrangement of the waterproof or dust-proof cloth member 116 at the sound discharge hole 103*b* of the housing 101 of the electronic equipment, resulting in facilitating assembling of the electronic equipment and reducing the number of parts.

In each of the embodiments described above, the display element 5 or 105 is increased in size. Alternatively, it may be reduced in size as in the prior art. This permits a space or area for arrangement of switches to be increased, to thereby facilitate operation of the switches or attains small-sizing of the housing.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. A piezoelectric acoustic device comprising:

a piezoelectric vibrator including a metal vibrating plate and a piezoelectric ceramic element joined to said metal vibrating plate;

a casing including a front side wall and a rear side wall arranged on both sides of said piezoelectric vibrator so as to define a space therebetween in which said piezoelectric vibrator is received; and a drum arranged on an outside of said front side wall so as to extend in a direction across said front side wall;

said piezoelectric vibrator and front side wall being arranged so as to define a chamber therebetween;

said drum being formed therein with a passage in a manner to communicate with said chamber;

said drum being so arranged that a center thereof is deviated from a center of said front side wall toward an outer peripheral portion of said front side wall.

2. A piezoelectric acoustic device comprising:

a piezoelectric vibrator including a metal vibrating plate and a piezoelectric ceramic element joined to said metal vibrating plate;

a casing including a front side wall and a rear side wall arranged on both sides of said piezoelectric vibrator so as to define a space therebetween in which said piezoelectric vibrator is received; and a drum arranged on an outside of said front side wall so as to extend in a direction across said front side wall;

said piezoelectric vibrator and front side wall being arranged so as to define a chamber therebetween;

said drum being formed therein with a passage in a manner to communicate with said chamber;

said drum being so arranged that a center thereof is deviated from a center of said front side wall toward an outer peripheral portion of said front side wall;

wherein said front side wall is formed thereon with at least one spacer projection in a manner to extend in a direction identical with said drum;

said spacer projection being formed into a length smaller than that of said drum.

3. A piezoelectric acoustic device comprising:

a piezoelectric vibrator including a metal vibrating plate and a piezoelectric ceramic element joined to said metal vibrating plate;

a casing including a front side wall and a rear side wall arranged on both sides of said piezoelectric vibrator so as to define a space therebetween in which said piezoelectric vibrator is received; and a drum arranged on an outside of said front side wall so as to extend in a direction across said front side wall;

said piezoelectric vibrator and front side wall being arranged so as to define a chamber therebetween;

said drum being formed therein with a passage in a manner to communicate with said chamber;

said drum being so arranged that a center thereof is deviated from a center of said front side wall toward an outer peripheral portion of said front side wall;

wherein said drum and front side wall each are formed into a cylindrical configuration; and said drum is formed into a diameter smaller than a radius of said front side wall.

4. A piezoelectric acoustic device comprising:

a piezoelectric vibrator including a metal vibrating plate and a piezoelectric ceramic element joined to said metal vibrating plate;

a casing including a front side wall and a rear side wall arranged on both sides of said piezoelectric vibrator so as to define a space therebetween in which said piezoelectric vibrator is received; and a drum arranged on an outside of said front side wall so as to extend in a direction across said front side wall;

said piezoelectric vibrator and front side wall being arranged so as to define a chamber therebetween;

said drum being formed therein with a passage in a manner to communicate with said chamber;

said drum being so arranged that a center thereof is deviated from a center of said front side wall toward an outer peripheral portion of said front side wall;

wherein said passage of said drum is closed at an opening thereof facing said chamber with a damping cloth member.

5. A piezoelectric acoustic device comprising:

a piezoelectric vibrator including a metal vibrating plate and a piezoelectric ceramic element joined to said metal vibrating plate;

a casing including a front side wall and a rear side wall arranged on both sides of said piezoelectric vibrator so as to define a space therebetween in which said piezoelectric vibrator is received; and a drum arranged on an outside of said front side wall so as to extend in a direction across said front side wall;

said piezoelectric vibrator and front side wall being arranged so as to define a chamber therebetween;

said drum being formed therein with a passage in a manner to communicate with said chamber;

said drum being so arranged that a center thereof is deviated from a center of said front side wall toward an outer peripheral portion of said front side wall;

wherein said piezoelectric vibrator is joined at an outer peripheral edge thereof to an inner surface of said casing by means of a pressuresensitive adhesive, resulting in being fixed in said casing.

6. A piezoelectric acoustic device comprising:

a piezoelectric vibrator including a metal vibrating plate and a piezoelectric ceramic element joined to said metal vibrating plate;

a casing including a front side wall and a rear side wall arranged on both sides of said piezoelectric vibrator so as to define a space therebetween in which said piezoelectric vibrator is received;

said front side wall and piezoelectric vibrator being arranged so as to define a first chamber therebetween;

said front side wall being formed with a front side opening which permits said first chamber to communicate with an exterior of said casing therethrough;

said rear side wall and piezoelectric vibrator being arranged so as to define a second chamber therebetween;

said rear side wall being formed with a rear side opening which permits said second chamber to communicate with the exterior of said casing therethrough;

a drum arranged on an outside of said front side wall so as to extend in a direction across said front side wall;

said drum being formed therein with a passage in a manner to communicate with said first chamber through said front side opening;

said drum being so arranged that a center thereof is deviated from a center of said front side wall toward an outer peripheral portion of said front side wall; and a damping cloth member arranged so as to close said front side opening.

7. A piezoelectric acoustic device as defined in claim 6, wherein said front side wall is formed thereon with at least one spacer projection in a manner to extend in a direction identical with said drum;

said spacer projection being formed into a length smaller than that of said drum.

8. A piezoelectric acoustic device as defined in claim 6, wherein said casing is constituted by a combination of a first casing half including said drum and front side wall and a second casing half including said rear side wall; and said damping cloth member is joined to an inner surface of said first casing half by means of a pressure-sensitive adhesive.

9. A piezoelectric acoustic device as defined in claim 6, wherein said drum and front side wall each are formed into a cylindrical configuration; and said drum is formed into a diameter smaller than a radius of said front side wall.

10. A piezoelectric acoustic device as defined in claim 6, wherein said piezoelectric vibrator is joined at an outer peripheral edge thereof to an inner surface of said casing by means of a pressure-sensitive adhesive, resulting in being fixed in said casing.

* * * * *